US005839499A

United States Patent [19]

Sarkisyan et al.

[11] Patent Number: 5,839,499

[45] Date of Patent: Nov. 24, 1998

[54] ONE-SHOT MULTI-COLOR GOLD CASTING APPARATUS AND CASTING TREE

[76] Inventors: Gevork Sarkisyan, 2800 Montrose Ave. 201, Lacrescenta, Calif. 91214; Ashot Sarkissian, 3930 Los Feliz BL. 110, Los Angeles, Calif. 90027

[21] Appl. No.: 81,868

[22] Filed: May 20, 1998

Related U.S. Application Data

[60] Division of Ser. No. 834,918, Apr. 7, 1997, which is a continuation-in-part of Ser. No. 510,743, Dec. 16, 1996, abandoned.

[51] Int. Cl.[6] ..... B22C 7/02; B22C 9/04

[52] U.S. Cl. ..... 164/244; 164/246; 164/361; 164/376; 249/62

[58] Field of Search ..... 164/235, 237–239, 164/241–246, 249, 350, 361, 374, 376; 249/54, 61, 62

[56] References Cited

U.S. PATENT DOCUMENTS

| | | | |
|---|---|---|---|
| 4,246,954 | 1/1981 | Cohen et al. | 164/244 X |
| 4,614,217 | 9/1986 | Keaton | 164/350 X |
| 4,700,760 | 10/1987 | Weingarten | 164/244 |
| 4,706,730 | 11/1987 | Sanchez-Caldera et al. | 164/135 |

*Primary Examiner*—J. Reed Batten, Jr.
*Attorney, Agent, or Firm*—Alexander R. Ginzburg

[57] ABSTRACT

The apparatus includes a rubber base with two inlets, a two-chamber ceramic crucible with two identical outlets, and a model of the jewelry item with two sprues connected to two separate tree stems, with each sprue connected to a separate stem thus ensuring flow of different colors or different metals. Simultaneous casting of two different metal alloys of different colors in two separate chambers of the crucible is achieved by using a specially constructed two-head torch.

3 Claims, 3 Drawing Sheets

ONE-SHOT MULTI-COLOR GOLD CASTING APPARATUS AND CASTING TREE

This application is a divisional of application No. 08/834,918 filed Apr. 7, 1997 pending which was a continuation-in-part of application No. 08/510,743 filed on Dec. 16, 1996 and now abandoned. This application incorporates these prior Applications by reference.

BACKGROUND OF THE INVENTION

1. Field of the Invention

This invention relates, generally, to a lost wax casting tree and the method of use thereof, in an investment molding process. More particularly, the invention relates to a casting tree which permits forming two-color jewelry items, such as rings or brooches, within a single flask, utilizing several specially constructed or improved devices, such as a two-chamber ceramic crucible and a two-head gas torch, and otherwise standard equipment.

2. Description of the Prior Art

The lost wax/investment molding procedure has found considerable application in dental, jewelry and allied fields where the precise reproduction of an article, as represented by an expendable pattern, is desired. The process is generally characterized by the formation of a wax or plastic pattern which is embedded in a mixture of refractory investment materials. The resulting pattern is then subjected to heat, in order to drive out moisture from the investment material, to harden it and to melt the wax or plastic from the pattern. Finally, the molten material which is to be cast in the mold is poured into the investment material die and, when the molten material has sufficiently cooled, the die is removed leaving a precise reproduction of the article originally represented by the wax or plastic pattern. For the purposes of this application, the terminology "wax" or "plastic" is intended to include all those materials which are normally used or are suitable for use in the various lost wax casting processes to which the present invention relates.

The use of a soft material, such as waxes or plastics normally employed in lost wax casting processes, gives considerable leeway to the person preparing the casting as these materials are easily worked. Thus, an artist can cast his idea in wax and thereafter have it precisely executed in gold or other suitable material. The ease with which the lost wax techniques can be applied have made them useful for dentists in casting the filling for a cavity or replacing a tooth. Wax can be pressed into a cavity of a tooth, once the cavity has been cleaned, to form an exact duplicate of the cavity. This wax model is then used to form an investment material die wherein gold or other material may be cast to produce a filling for the tooth.

In order to cast molten metal into a prepared mold, a conduit leading to the mold is usually formed. This is accomplished by attaching a piece of fusible material, such as a rod of wax or plastic, to the item being cast. When the wax or plastic is removed a conduit to the mold is formed.

One method of forming a conduit leading to the mold is to attach a rod of the wax or plastic material, known as a sprue, to each wax pattern, and form the casting mold or flask about these individual patterns. The molten gold or other material is then poured into a funnel shaped cavity formed near the surface of the mold, in communication with each sprue or rod. The use of a sprue or sprues is shown, for example, in connection with the formation of various dental castings in U.S. Pat. No. 1,595,338 to Brazda et al. An improved sprue device which can be adjusted to support various size patterns by bending a U-shaped double sprue to form a wider or narrower "U", as required by the extent of the pattern, is shown U.S. Pat. No. 2,468,479 to Barishman. This also provides two passages through which molten material can flow to the pattern. U.S. Pat. No. 3,610,317 to Benfield et al., again shows the use of a sprue or plurality of sprues, each attached to a wax pattern to form conduit to the mold formed by the wax pattern.

A sprue may either be of a fusible material which can be melted from the investment mold, or of a metal which must be withdrawn to permit the wax or plastic used to form the pattern to flow out of the investment mold.

The use of a second sprue which may communicate with one or more of the wax patterns to form a second conduit for the molten material is also shown in Benfield. This second conduit helps to insure complete filling of the pattern especially where there are thin sections in the pattern which might prematurely block the flow of molten material through the main sprue formed conduit. U.S. Pat. No. 3,322,187 to Weissman shows a still further arrangement wherein conduits are formed to a number of patterns by separate sprues associated with each pattern. U.S. Pat. No. 2,065,977 to Jefferies, although generally concerned with a method of vibrating the investment materials to form a tight mold, again shows the basic technique of the use of sprues to form conduits directly to the wax patterns.

Although utilizing basically the same technique, it has been found advantageous to cast a larger number of small items in a vertical mold that was previously attained by the use of individual sprues extending from the opening in the mold, so that a larger number of items are formed from the same casting operation with a minimum of equipment and a minimum of waste of investment molding material. Basically, this is accomplished by forming a "tree" of a fusible material to which is attached the various wax or plastic patterns by means of individual sprues. The result is a single stem which forms a central conduit extending generally vertically into the investment material, with a number of branches extending therefrom to the individual patterns. In general, the tree is formed by first attaching a sprue to the wax or plastic model and then attaching the other end of the sprue to the central stem by the addition of wax or by melting or otherwise. With various modifications in the equipment used or the technique employed, this basic process is shown in U.S. Pat. No. 3,648,760 to Cooper with reference to dental casting; and in U.S. Pat. No. 3,402,755 to Christian, with reference to jewelry articles in general. It has recently become popular to have jewelry, and in particular rings, formed of both white and yellow gold. This is normally accomplished by separately casting the yellow gold portions and the white gold portions of the jewelry piece and thereafter assembling the portions by soldering or other usual means. Several practical problems are encountered when this type of jewelry is made. These problems are associated with the fact that each part must be separately cast and the various parts thereafter matched to each other and assembled. For example, many jewelry items are formed of individualized parts or pieces that are not interchangeable. This requires that some accurate inventory method be used to assure that the right parts come together so that the person assembling them can work effectively. Even when a large number of interchangeable parts are involved, separate casting of each part still requires that there be some inventory method used to insure that the various parts are properly brought together.

An attempt at solving that problem by forming the parts of two-color jewelry item in a single casting flask was made by Abraham M. Cohen and Henry L. James, U.S. Pat. No. 4,246,954. The method used by the authors is based on a main wax stem with an auxiliary branch, and a non -fusible ceramic separator between the two portions of the main conduit.

Though combining metal casting in a single flask, this method still requires further soldering for completing a two-color jewelry item. Considerable economy of working time and plaster investment powder is obvious, but, even with this latest invention, all presently known methods of casting require at least two steps to complete a two-color jewelry piece, meaning casting and further assembly.

A method of supplying dissimilar materials simultaneously through separate channels was introduced by Luis E. Sanchez-Caldera et al in U.S. Pat. No. 4,706,730. That method relates to mixing and casting apparatus and processors, the invention including supplying of dissimilar substances to the mixing region by separate channels in order to form a mixture by means of chemical reaction. Although using the idea of separate channels to supply different substances, the present invention has as a goal not a mixture but the opposite purpose of combining two colors in a single jewelry item with a distinguishable multi-color appearance, and a smooth transition between the two main colors.

SUMMARY OF THE INVENTION

The present invention has as a main object to provide a means, and a method of using the means, whereby two different materials, and in particular two colors of metal (such as white gold and yellow gold), can be cast in the same flask by simultaneous pouring of the two molten metals to create a multi-color jewelry item.

It is a related object and feature of the present invention to provide a tree for preparing a tandem mold wherein different metals or metal alloys can be melted separately and simultaneously.

It is a still related object, feature and advantage of the present invention to provide a mold wherein a single item may be cast in an uninterrupted process till the final outcome as a complete jewelry art-work.

It is a still related object, feature and advantage of the present invention to provide a two-head gas torch for heating metals separately and simultaneously in a two-chamber ceramic crucible.

Briefly, a method according to the present invention, for simultaneous manufacturing of a two-color jewelry item within a single tree, is based on utilization of the specially constructed for this purpose rubber base, ceramic two-chamber crucible and two-head gas torch.

Two identical vertical wax stems are connected to the rubber base through two rubber inlets. The distance between stems is determined, generally, by the size and mass of a jewelry item. The main distinguishing innovation of the suggested method, together with the rubber base, two-chamber ceramic crucible and two-head gas torch, is a method of connecting a wax impression of a jewelry item to the tree stems by two sprues, with each sprue connected to a separate stem thus ensuring flow of different colors or different metals. Two prepared colors of the same metal or two different metals are melted in a two-chamber ceramic crucible with a non-fusible separator separating metals in the process of melting. After simultaneous melting of the two metals is achieved by the two-head gas torch, using pre-selected temperatures, both substances are then poured into the flask by centrifugal casting machine. Due to the pre-selected consistencies of the metals, achieved by simultaneous heating by the two-head torch, the jewelry item will have a distinctive two-color appearance with a slight diffusive effect of a smooth color transition between the two metals, which creates a unique effect of subtle color tinges on a jewelry piece.

Additional features of the invention will be more fully appreciated from a more detailed description of the invention taken in conjunction with the accompanying drawings.

DESCRIPTION OF THE PREFERRED EMBODIMENTS

Rubber base.

Figure 6:
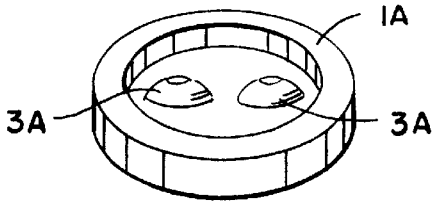
FIG. 6 is a view of a specially constructed rubber base with two rubber inlets.

As shown in FIG. 6, the rubber base 1A is made of standard material with two identical inlets 3A further providing two-channel flow of different metal alloys to the plaster mold.

Figure 1:
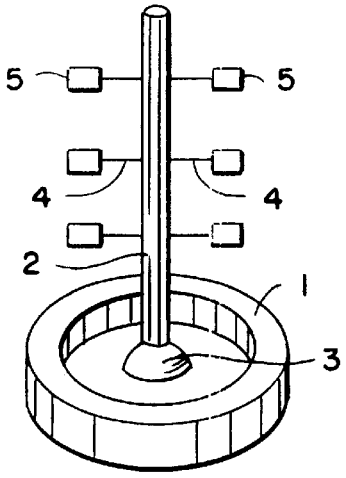
FIG. 1 (PRIOR ART)
FIG. 1 is a perspective view of a standard wax tree with a rubber base with one inlet, as it is used in known casting methods.
Figure 2:
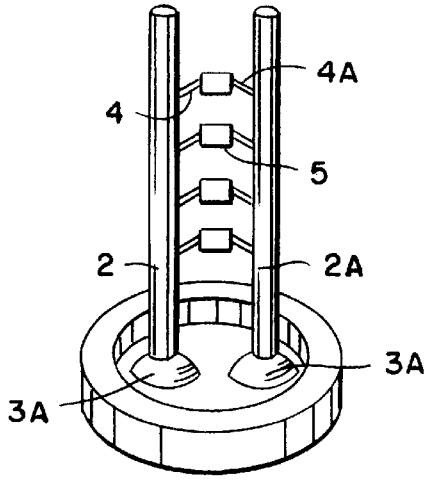
FIG. 2 is a perspective view of a two-stem tree with a specially constructed rubber base showing the new approach to placing and connecting wax impressions (jewelry items-waxes) to the stems by two separate sprues.

As shown in FIG. 2, two wax stems 2 and 2A are separated from each other and connected to wax impressions of jewelry items 5. The wax impressions are connected to the stems 2 and 2A with two sprues 4 and 4A. Position, size, connection angle and number of sprues will depend on the size and mass of the jewelry item being cast. Tree stems 2 and 2A are made of fusible material such as usually employed wax, further providing channels for pouring different metal alloys.

Two-chamber ceramic crucible.

Figure 3:
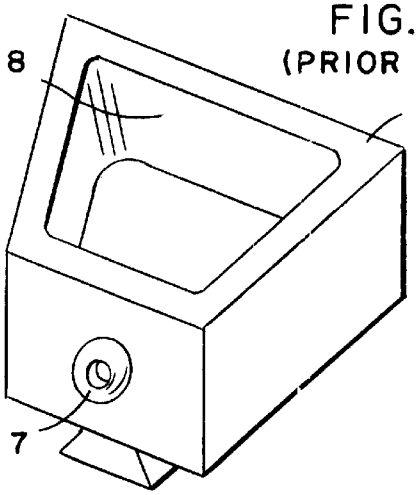
FIG.3 (PRIOR ART)
FIG. 3 is a view of a ceramic crucible according to the standard method of casting.
Figure 4:
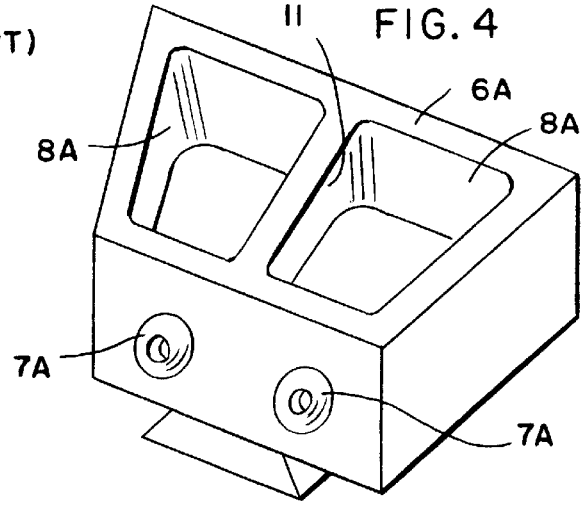
FIG. 4 is a view of a two-chamber ceramic crucible, specially constructed for the present invention, which allows simultaneous melting of two different materials.
Figure 5:
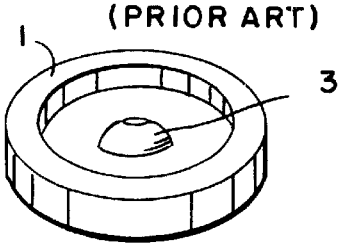
FIG. 5 (PRIOR ART)
FIG. 5 is a view of a standard rubber base with one inlet.

As shown on FIG. 3, a standard crucible 6 has one outlet 7 and one melting chamber 8. FIG. 4 shows a two-chamber ceramic crucible 6A suggested in the present invention, with two melting chambers 8A and two outlets 7A. A non-fusible ceramic separator 11 between chambers 8A provides for separate melting of two substances. The positions of the outlets 7A on the ceramic crucible corresponds to inlets 3A on the rubber base 1A, as shown in FIG. 6. This position ensures an outflow of molten metal alloys into the previously prepared plaster mold 13 with a flask 12, as shown in FIG. 7.

Figure 7:
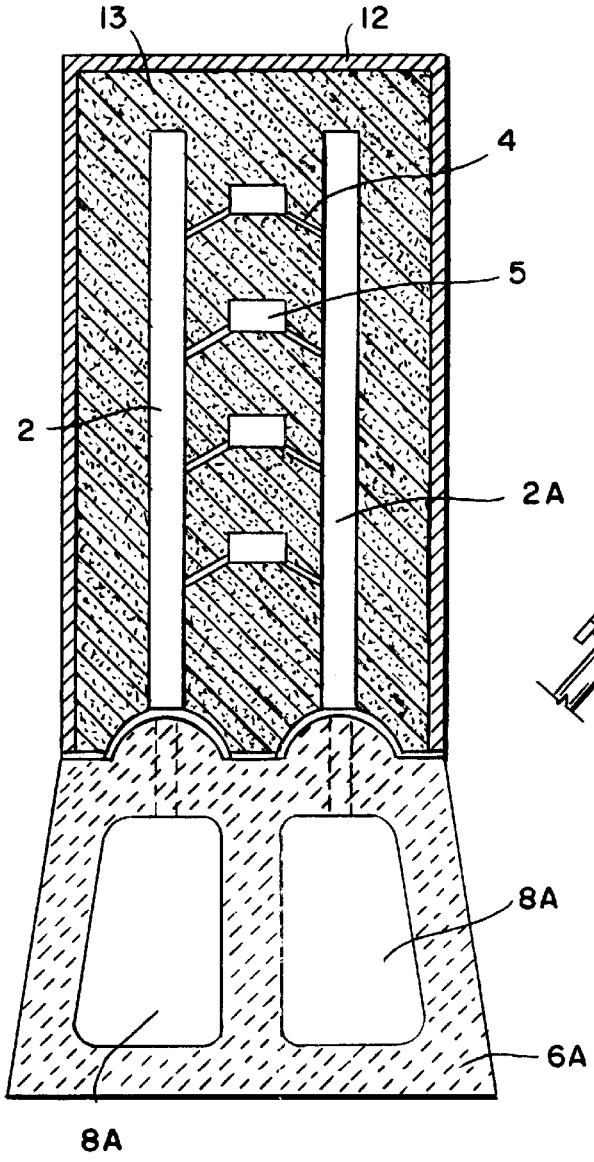
FIG. 7 is a view of a complete flask with a formed casting mold together with a two-chamber ceramic crucible ready for melting and casting of two different materials.

With reference to FIG. 7, the present invention device includes a two-chamber ceramic crucible 6A. FIG. 7 shows the position of the plaster mold 13 with a flask 12 adjacent to the ceramic crucible 6A, ready for casting of two different metals or metal alloys.

Two-head gas torch.

Figure 8:
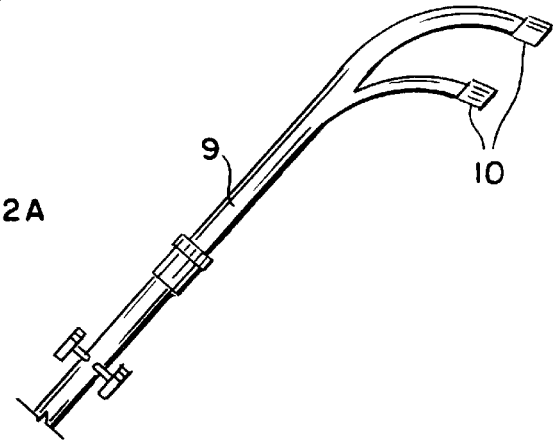
FIG. 8 is a view of a two-head gas torch, specially constructed and suggested as a part of present invention.

As shown in FIG. 8, simultaneous melting of dissimilar metals or metal alloys in the ceramic crucible 6A is ensured by use of a specially constructed for the suggested invention gas torch 9 with two heads 10.

METHOD OF USE

The present invention casting tree is preferably used in a casting method similar to the presently practiced prior art method except that the use of the present invention results in a tandem mold casting flask into which two different types of molten casting materials may be poured simultaneously for one-shot casting of multi-color jewelry items. The resulting jewelry piece will be a unique art-work, with a non-repeatable color pattern.

Figure 9:
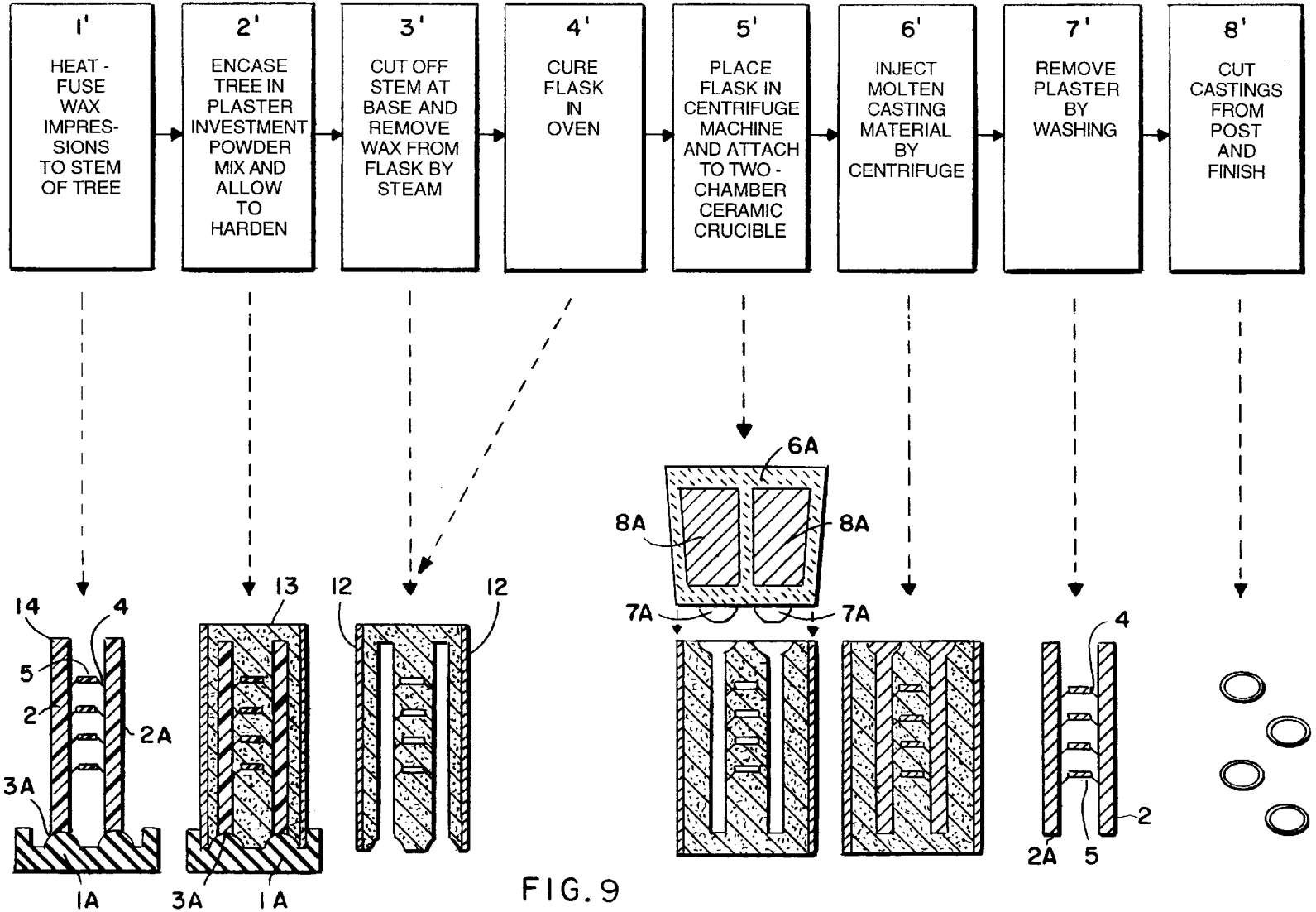
FIG. 9 is a diagrammatic representation of a preferred method of simultaneous multi-color casting, suggested for use of the present invention device.

The step-by-step technological process of simultaneous casting of multi-color jewelry items is shown in FIG. 9. With reference to FIG. 9, the presently preferred method of casting a multi-color jewelry piece in d single flask, using two different metals cast simultaneously, is as follows:

1. Wax impressions 5 are heat-fused to separate upstanding wax stems 2 and 2A mounted on a single rubber base 1A with two rubber inlets 3A as described above, using two sprues 4 for each wax impression.

2. The assembled two-stem tree 14 is then encased with plaster powder investment 13. The investment is mixed with water and the composition hardens to form a flask 12.

3. The base 1A is then cut away from the flask 12, and the wax and other fusible materials used to form the tree 14 are removed from the flask 12 by melting, usually with the aid of steam.

4. The flask 12 is then cured in an oven to remove excess water and to thereby set the investment mold. At this point, the flask, formed from cured investment material, will function as a cavity or mold for receiving the materials to be cast. As part of the curing step, the flask is heated for a period of time (4 hrs–12 hrs) and brought to a temperature compatible with the characteristics of the materials to be cast.

5. The flask is then placed in the centrifugal machine, which assists in drawing molten metals into the mold. As would be obvious, other methods of causing material to flow completely into the mold, as are normally employed, may be used, such as a vacuum tank. The flask is then attached to the two-chamber ceramic crucible 6A with separate outlets 7A for each chamber 8A to provide for the outflow of molten materials.

6. The crucible is then heated with the two-head gas torch, wherein each head of the torch corresponds to the chamber 8A of the crucible. As can be seen in FIG. 9, the cavity formed in the investment material comprises two separate channels for two different materials to flow simultaneously from two sides to form a multi-color jewelry item. The transition between the two main colors will appear at some point on the jewelry item, depending on the pre-selected temperatures (consistencies) of the two molten metals. After the casting alloys are centrifugally injected into the flask, the flask is allowed to cool.

7. The investment material or plaster 15 is then removed from the cooled flask, normally by washing, to release the cast tree.

8. The final step is to cut the castings 5 from the post formed by the mold outline of the tree stems, and finishing the jewelry pieces by polishing.

What is claimed is:

1. An apparatus for simultaneous casting of a multi-color piece comprising:

a casting mold including:

a base having a first inlet and a second inlet;

a first stem-shaped cavity continuing upward from said first inlet;

a second stem-shaped cavity continuing upward from said second inlet;

at least one model cavity corresponding to the shape of said multi-color piece;

a first sprue-shaped cavity connecting said model cavity to said first stem-shaped cavity; and a second sprue-shaped cavity connecting said model cavity to said second stem-shaped cavity;

a ceramic crucible having a first chamber and a second chamber, adapted to mate with said base so that a first metallic substance melted in said first chamber can be introduced into said first inlet and a second metallic substance melted in said second chamber can be introduced into said second inlet;

said first metallic substance having a color different from that of said second metallic substance; and a two-head torch designed for simultaneously heating each of said chambers.

2. An apparatus as claimed in claim 1 in which said metallic substance is selected from the group consisting of a pure metal and a metal alloy.

3. A casting tree for simultaneous casting of a multi-color piece comprising:

a flexible base having a first inlet and a second inlet;

a first fusible stem attached to said first inlet;

a second fusible stem attached to said second inlet;

at least one fusible model of said multi-color piece;

a first fusible sprue connecting said fusible model to said first stem; and a second fusible sprue connecting said fusible model to said second stem.

* * * * *